US007128285B2

(12) United States Patent
Fujita

(10) Patent No.: US 7,128,285 B2
(45) Date of Patent: Oct. 31, 2006

(54) DISINTEGRATOR WITH ROTATIVE DISK CUTTERS

(75) Inventor: Tsutomu Fujita, Suita (JP)

(73) Assignee: Kabushiki Kaisha Igusundo, Osaka (JP)

( * ) Notice: Subject to any disclaimer, the term of this patent is extended or adjusted under 35 U.S.C. 154(b) by 0 days.

(21) Appl. No.: 10/484,447

(22) PCT Filed: Jul. 25, 2002

(86) PCT No.: PCT/JP02/07516

§ 371 (c)(1),
(2), (4) Date: Jan. 21, 2004

(87) PCT Pub. No.: WO03/009941

PCT Pub. Date: Feb. 6, 2003

(65) Prior Publication Data

US 2004/0206836 A1 Oct. 21, 2004

(30) Foreign Application Priority Data

Jul. 27, 2001 (JP) ..... 2001-227635

(51) Int. Cl.
*B02C 7/04* (2006.01)

(52) U.S. Cl. ..... 241/235; 241/142; 241/143; 241/158; 241/159; 241/166; 241/167; 241/236

(58) Field of Classification Search ..... 241/143, 241/159, 167, 235, 236, 142, 158, 166
See application file for complete search history.

(56) References Cited

U.S. PATENT DOCUMENTS 3,682,396 A * 8/1972 Whitney et al. ..... 241/41
5,836,527 A * 11/1998 Irwin et al. ..... 241/49
6,439,486 B1 * 8/2002 Nitta et al. ..... 241/29

FOREIGN PATENT DOCUMENTS

| | | |
|---|---|---|
| JP | 1-236952 | 9/1989 |
| JP | 4-190858 | 7/1992 |
| JP | 2000-33280 | 2/2002 |

* cited by examiner

*Primary Examiner*—Derris H. Banks
*Assistant Examiner*—Jason Y. Pahng
(74) *Attorney, Agent, or Firm*—Crowell & Moring LLP

(57) ABSTRACT

An object of the present invention is to diminish the sizes of most disintegrated material effectively, said sizes being determined by the box seats made on the surface of the under roll (7).

In a disintegrator (1) having a case (4) with an upper hopper 2 and under exit (3), a pair of upper rolls (5, 6), an under roll (7) located below the upper rolls, and knives (8,9) projecting from inner surface of the case (4) toward the under roll (7) comprising a number of annular grooves (25) formed on the under roll (7), each groove (25) being coupled by a rotative disk cutter (27) at under side of the knives (8, 9). The under roll (7) is provided with polygonal installation seats (13), between adjoining installation seats (13) each attached by a number of cutting edge blocks (14) on a same circumference, said annular grooves (25) are formed between the adjoining installation seats (13).

8 Claims, 3 Drawing Sheets

DISINTEGRATOR WITH ROTATIVE DISK CUTTERS

TECHNICAL FIELD

This invention relates to improvements on a disintegrator to disintegrate large-sized industrial wastes, unwanted article from homes etc. into small-sized pieces.

BACKGROUND ART

FIG. 3 shows a vertical section of a conventional disintegrator 1, in which in a case 4 having an upper hopper 2 and under exit 3, there are provided with a pair of upper rolls 5 and 6, an under roll 7 located below the upper rolls, and knives 8 and 9 (9 is prepared for reverse rotation of under roll) projecting from inner surface of case 4 toward the under roll 7. Disintegrative materials 10 thrown inside the hopper 2 are disintegrated between the upper rolls 5, 6 driven as arrows while moving downward, then after disintegrated between the under roll 7 and knives 8, 9, and exited downward from the exit 3.

As shown in FIG. 4, under roll 7 is provided with six cutting edge blocks 14 each of which is fastened by bolts 15 on one of hexagonal installation seats 13 circumferentially formed on outer surface of cylindrical tubular body 12. The construction in the FIGS. 3 and 4 are generally shown in Japanese Examined Patent Application 2(1990)-38259.

FIG. 5 shows another conventional structure corresponding to a view of arrow V in the FIG. 3. Upper rolls 5 and 6 in FIG. 5 have helical blades 17 and 18 respectively, then disintegrative materials put between the upper rolls 5 and 6 are driven to the right by the upper roll 5, and to the left by the upper roll 6 thereby sheared by the opposing blades 17 and 18 and fell on the under roll 7. The under roll 7 shown in the FIG. 5 is provided with helical blades 19 and 20 intersecting each other formed integrally on the surface of the under roll, the blades 19 and 20 forming a number of box seats 21 opened radially outwardly. Disintegrative materials are received in the box seats 21 and parts of the materials projecting from the box seats 21 are cut by knives 8 and 9, and most parts remaining in the box seats 21 fall down when the box seats reach lower position. Therefore, the size of the most disintegrated material pieces after passing the disintegrator is determined by longitudinal length L1, circumferential length L2 and the depth L3 of the box seat 21. This results in, when house wastes for example are disintegrated, the longer final bar like pieces such as 100~120 mm are obtained and such long pieces are not suitable for mixing in the livestock litter. If the length is below 30~50 mm, as urine of livestock is soaked, rotting is accelerated and easily change into favorable fertilizer, but it is impossible to cut into satisfactory short length. These disadvantages are not avoided by the cutting edge block 14 of FIG. 4.

DISCLOSURE OF INVENTION (Technical Problem to be Solved by the Invention)

An object of the present invention is to further diminish sizes of disintegrated material pieces fixed genarally by the box seats formed on the surface of the under roll.

(Solution for the Problem)

The claim 1 discloses a disintegrator having a case provided with an upper hopper and under exit, a pair of upper rolls, an under roll located below the upper rolls, and knives projecting from inner surface of the case toward the under roll comprising a number of annular grooves formed on the under roll, each groove being coupled by a rotative disk cutter at under side of the knives.

The claim 2 discloses a disintegrator as claimed in claim 1, said rotative disk cutter is provided with blades at radially middle part of the cutter to form a blower.

The claim 3 discloses a disintegrator as claimed in claim 1, inner surface of the case is provided with guides at under side of knives to guide disintegrated material pieces falling down from the knives to the engaging place between the rotative disk cutters and annular grooves.

The claim 4 discloses a disintegrator as claimed in claim 1, the under roll is provided with polygonal installation seats, between adjoining installation seats each attached by a number of cutting edge blocks on a same circumference an annular groove is formed.

The claim 5 discloses a disintegrator as claimed in claim 1, the exit is provided with a screen.

The claim 6 discloses a disintegrator as claimed in claim 1, the screen is connected to a vibration mechanism.

The claim 7 discloses a disintegrator as claimed in claim 1, the screen is slanted to the under roll.

The claim 8 discloses a disintegrator as claimed in claim 1, a send back mechanism is equipped for sending back disintegrated material remained on the screen.

(Effects Over Prior Arts)

According to the invention of claim 1, disintegrated material pieces retained in the box seats 21*a* of under roll 7 are, after sheared off the projecting heads by knife 8 (and/or 9) cut effectively by rotative disk cutters such as saw edges 27, and it is possible that the sizes of the final disintegrated material pieces are diminished.

According to the invention of claim 2, disintegrated material pieces fell down from the guides 44 are forced to move laterally increasing the chances to meet against the adjoining rotative disk cutters (for example saw edges 27) and annular grooves 25, causing increase of disintegrating efficiency.

According to the invention of claim 3, chances of disintegrated material pieces fell down from the guide 44 to meet against the adjoining rotative disk cutters (for example saw edges 27) and annular grooves 25 are increased, and it is possible to increase the disintegrating efficiency.

According to the invention of claim 4, it is advantageous to form annular grooves 25 easily.

According to the invention of claim 5, it is possible to make disintegrated material pieces into further smaller and more uniform.

According to the invention of claim 6, screening ability of the screen 46 increases.

According to the invention of claim 7, it is easy to gather the remaining large sized pieces on the screen 46.

According to the invention of claim 8, it is easy to disintegrate again the remaining large sized pieces on the screen 46.

BEST MODE FOR CARRYING OUT THE INVENTION

Figure 1:
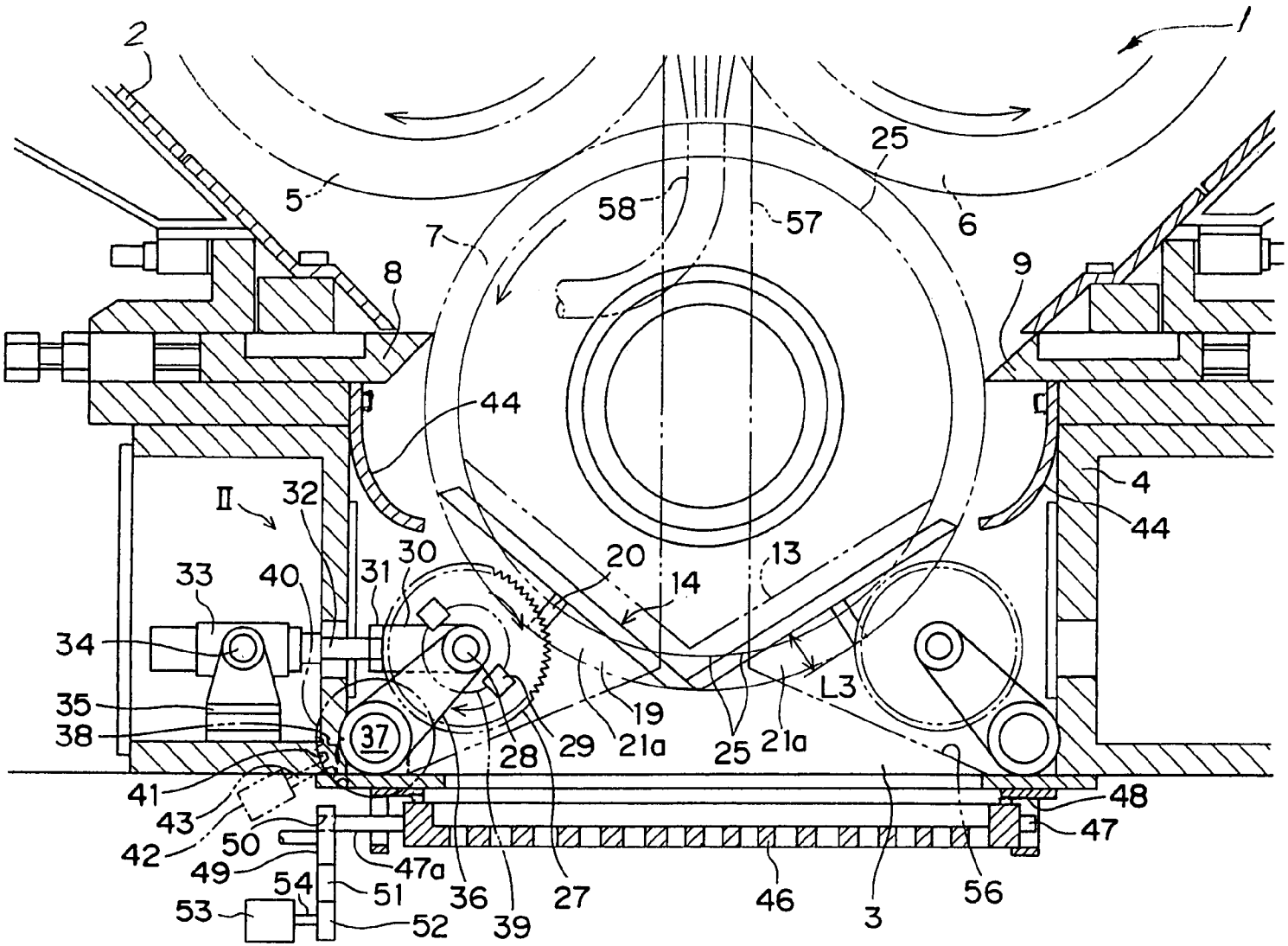
FIG. 1 is partially sectional vertical view showing a disintegrator according to the present invention.

In FIG. 1 an annular groove 25 is formed between under roll axially adjoining end faces of cutting edge blocks 14 fastened by bolts 15 on the hexagonal installation seats 13 of under roll 7, and since the cutting edge block 14 is provided with longitudinal blades 20 and circumferential blades 19 in one piece, the depth L3 of radially outwardly open box seats 21*a* and depth of annular groove 25 are about the same. In case the outer diameter of the under roll 7 is 250 mm for example, the width of the annular groove 25 (the depth measured perpendicular to the paper face of FIG. 1) is 3~5 mm for example, the depth L3 is 10~30 mm for example, the length of cutting edge block 14 measured in under roll longitudinal direction is 20~50 mm for example.

A saw edge 27 coupled into each annular groove 25 up to a short distance from the bottom or just before contact, is provided with sawlike irregularities on the circumference of a circular disk made of steel, is attached to a rotative axis 28, is provided with at least two cut and raised blades 29 on a same circle and at middle part of radius, one of which blade 29 project to the face side of the FIG. 1 as it projects more as it goes to anti rotational direction, and another blade projects same but to back side of the FIG. 1, forming a centrifugal blower on the both sides of the saw edge 27. Both ends of the rotative axis 28 are rotatably supported by arms 30, and both arms 30 are fixed to both ends of a cross member 31 extending to rectangular direction to the paper of FIG. 1. Longitudinally central portion of the cross member 31 is connected to a cylinder 33 through a rod 32, the cylinder 33 being supported to a bracket 35 by way of an axis 34. At both outer sides of both arms 30, the rotative axis 28 are rotatably supported by arms 36, proximal ends of the arms 36 are fixed to the support shaft 37, the shaft 37 being supported by a bracket 38 fixed on the case. On a distal end of the arm 36 a motor 39 is fixed, an output shaft of the motor 39 is connected directly to the rotative axis 28. A stopper disk 40 fixed to the end of support shaft 37 is provided with a number of recesses 41 on the outer periphery, distal end edge portion of a rod 43 fixed on the case engages into one of the recesses 41 preventing rotation of the support shaft 37.

44 are guides bolted inside surface of the case, guiding falling disintegrated material pieces lower than the knives 8 and 9 into engaging portion between the saw edges 27 and annular grooves 25.

In FIG. 1, screen 46 covers the cross section of the exit 3 taking some slant posture, shown screen 46 corresponding to its lowest position, the screen goes up as it goes toward back side of the FIG. 1 paper. Pins 47 located at four corners of the screen 46 are supported in guide grooves 48 made inside surface of the case somewhat movably up and down and forward and backward (perpendicular to the paper), one 47*a* of the pins 47 is rotatably supported in an excentric hole 50 made in a pully 49 supported by the case. The pulley 49 is connected to a pulley 52 through a belt 51, the pulley 52 is in turn fixed to an output shaft 54 of a motor 53. At direct close upper portion of lowest position (position shown in FIG. 1) of the screen 46, there is provided with a reverse funnel shaped suction port 56 which is open downwardly and extending long rectangularly right and left in FIG. 1, a suction duct 57 connected to the upper end of the suction port 56 extends upwardly and provided with an upward nozzle 58, from the nozzle 58 pressurized air forced by a not shown blower emitted upwardly, upper end of the duct 57 being connected to the hopper, thereby relatively large sized disintegrated material pieces remained on the screen 46 are returned to the hopper again.

Figure 2:
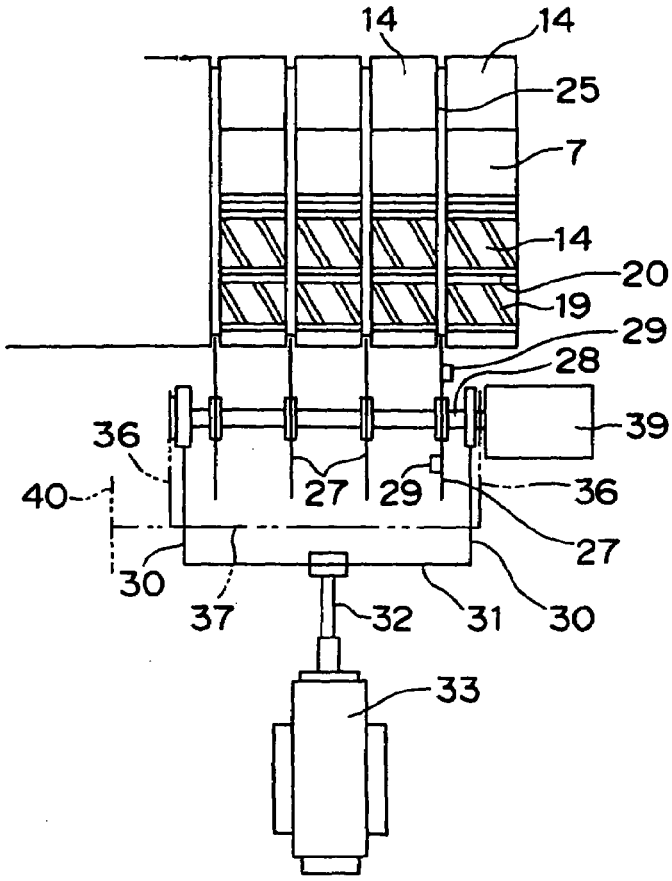
FIG. 2 shows a schematic view taken along an arrow 11 of FIG. 1.
Figure 3:
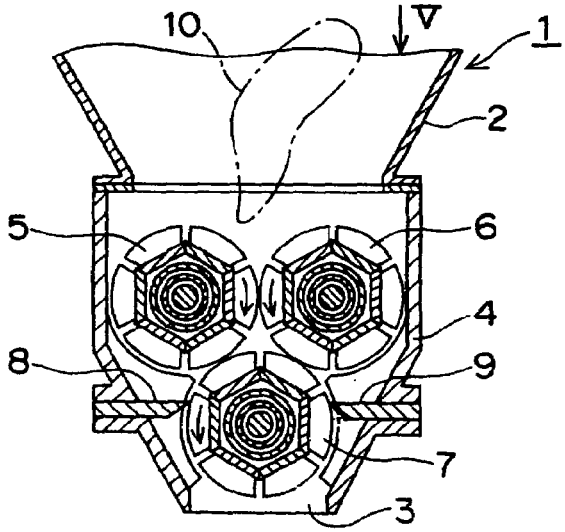
Fig.3 (Prior Art)
FIG. 3 shows a conventional section.
Figure 4:
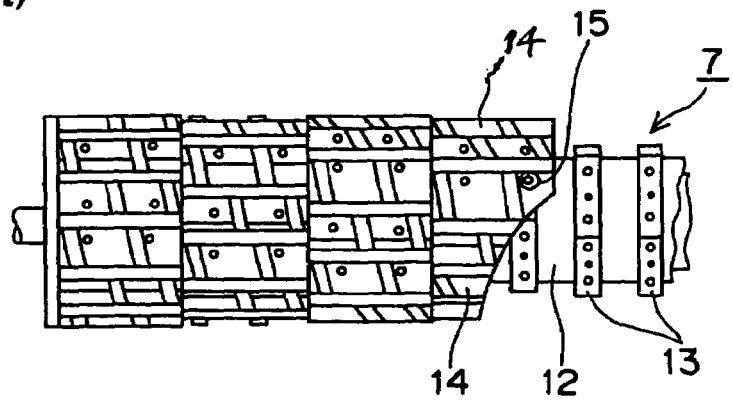
Fig.4 (Prior Art)
FIG. 4 is a partially broken plan view of under roll in FIG. 3.

In the FIG. 2, i.e. a part of FIG. 1 shown along arrow 11, cutting edge blocks 14 are fixed by bolts on the polygonal installation seats of tubular body (corresponding to 12 of FIG. 4) of under roll 7, between adjoining cutting edge blocks 14 disposed longitudinally on under roll 7, annular grooves 25 of 3~5 mm for example are formed, in which saw edges 27 with 1~1.5 mm thickness engage into the annular grooves 25 up to the bottoms nearly contact. The length of the cutting edge block 14 measured along the longitudinal direction of the under roll (right and left width in FIG. 2) is 20~50 mm for example.

Disintegrated material pieces by the upper rolls 5, 6 and under roll 7 (both 50~80 r.p.m. for example) are held in the box seats 21*a* of the under roll 7 and shear cut by knives 8 and 9, and disintegrated material held in the box seat 21*a* and lowered are cut into small pieces by saw edge 27 rotating by 1200~1600 r.p.m. for example. Among pieces fell on the screen 46, large sized pieces remaining on the screen 46 get together the lower position shown in FIG. 1 by given vibration of screen 46, air transferred to hopper from suction port 56, disintegrating process is repeated to finally get desirable size.

In place of the saw edges 27, rotative disk cutter like meat cutter with sharp edges each of which is provided with thickness generally smaller as it goes to the radially outward are emploied.

Figure 5:
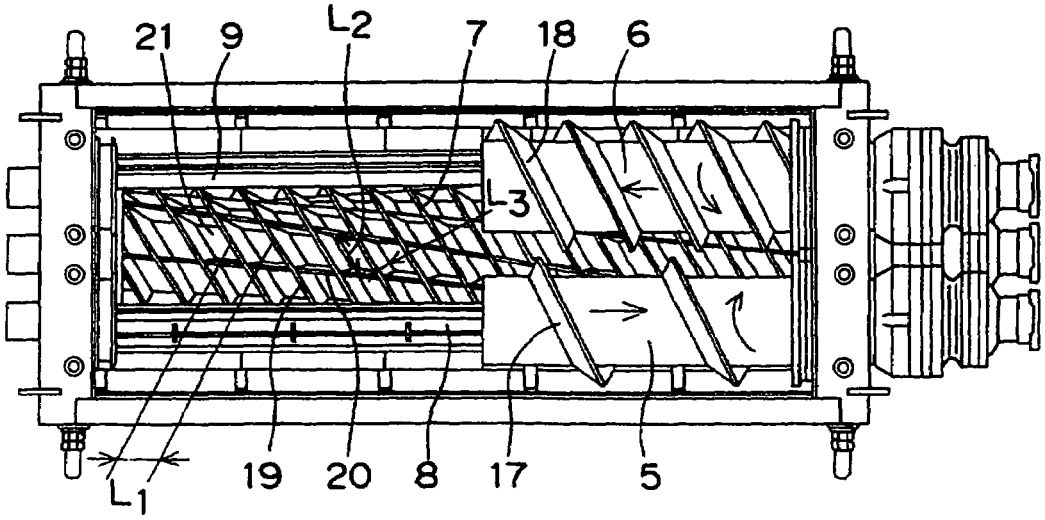
Fig.5 (Prior Art)
FIG. 5 shows another conventional view corresponding to FIG. 3 taking along an arrow V.

Of course, under roll 7 shown in FIG. 5 may be provided with a number of annular grooves.

INDUSTRIAL APPLICABILITY

Present invention is preferably applicable when house wastes for example are disintegrated into small pieces and mixed in the livestock litter and urine of livestock is soaked, rotting is accelerated and easily change into favorable fertilizer.

The invention claimed is:

1. In a disintegrator having a case (4) provided with an upper hopper 2 and an under exit (3), a pair of upper rolls (5, 6), an under roll (7) having a plurality of box seats formed thereon for holding disintegrated material, the under roll located below the upper rolls, and knives (8, 9) projecting from inner surface of the case (4) towards the under roll (7), the improvement comprising:

a number of rotative disk-shaped cutters (27) located below the knives (8, 9), wherein the under roll (7) includes a number of annular grooves (25) formed thereon, each annular groove (25) dividing at least one of the box seats and engaging at least one of the rotative disk-shaped cutters (27), whereby, in operation, disintegrated material retained in each of the divided box seats is further disintegrated by a corresponding rotative disk-shaped cutter.

2. A disintegrator as claimed in claim 1, wherein each rotative disk-shaped cutter (27) includes blades (29) located at a radially middle part of the rotative disk-shaped cutter to form a blower.

3. A disintegrator as claimed in claim 1, wherein the inner surface of the case (4) includes guides (44) positioned below the knives (8, 9) to guide disintegrated material pieces falling down from the knives (8, 9) to the engaging place between the rotative disk-shaped cutters (27) and annular grooves (25).

4. A disintegrator as claimed in claim 1, wherein the under roll (7) includes polygonal installation seats (13), and wherein between adjoining installation seats (13) a number of cutting edge blocks (14) are attached on the same circumference an annular groove (25) is formed.

5. A disintegrator as claimed in claim 1, wherein the exit (3) includes a screen (46).

6. A disintegrator as claimed in claim 5, further comprising a vibration mechanism (49) connected to the screen.

7. A disintegrator as claimed in claim 5, wherein the screen (46) is slanted to the under roll (7).

8. A disintegrator as claimed in claim 5, further comprising a send back mechanism (56, 57, 58) equipped for sending back disintegrated material remained on the screen (46).

* * * * *

UNITED STATES PATENT AND TRADEMARK OFFICE

CERTIFICATE OF CORRECTION

PATENT NO. : 7,128,285 B2
APPLICATION NO. : 10/484447
DATED : October 31, 2006
INVENTOR(S) : Tsutomu Fujita It is certified that error appears in the above-identified patent and that said Letters Patent is hereby corrected as shown below:

Title Page please change item (73) as follows:

(73) Assignee: Kabushiki Kaisha Igusundo Japan, Suita, Japan

Signed and Sealed this

Sixteenth Day of June, 2009

JOHN DOLL
*Acting Director of the United States Patent and Trademark Office*